US006276425B1

(12) United States Patent
Mausar et al.

(10) Patent No.: US 6,276,425 B1
(45) Date of Patent: Aug. 21, 2001

(54) FINGERTIP GRIP RAIL FOR A WINDOW SHADE APPARATUS

(75) Inventors: Ben Mausar, Elkart, IN (US); Ron Green, Orange, CA (US); Nick Donis, Elkar, IN (US)

(73) Assignee: Irvine Shade & Door, Inc., Elkhart, IN (US)

( * ) Notice: Subject to any disclaimer, the term of this patent is extended or adjusted under 35 U.S.C. 154(b) by 0 days.

(21) Appl. No.: 09/563,852

(22) Filed: May 4, 2000

(51) Int. Cl.[7] ..... E06B 3/94
(52) U.S. Cl. ..... 160/84.03
(58) Field of Search ..... 160/84.03, 84.01, 160/84.04, 84.05, 84.06, 115, 170 R, 172 R, 173 R

(56) References Cited

U.S. PATENT DOCUMENTS 4,733,711 * 3/1988 Schon ..... 160/84.03
4,762,159 * 8/1988 Ford ..... 160/84.06
4,807,686 * 2/1989 Schnebly et al. ..... 160/84.02
4,813,468 * 3/1989 Fraser ..... 160/84.03
5,899,424 5/1999 Williams, Jr. .
5,944,084 8/1999 Cadorette .
5,960,846 10/1999 Lysyj .
5,996,668 12/1999 DeBlock et al. .

OTHER PUBLICATIONS

Photos of device that is depicted in FIG. 1 of the original application.*

* cited by examiner

*Primary Examiner*—David M. Purol
(74) *Attorney, Agent, or Firm*—Barnes & Thornburg

(57) ABSTRACT

An intermediate rail, also known as a day/night rail, for placement between the phases of pleated window shade that has at least two distinct phases. The intermediate rail has a fingertip recess running substantially along the entire length of the rail. Additionally, the fingertip recess is sufficiently wide to enable a user's fingers to enter the recess in order to grip the rail so that the rail may be moved.

18 Claims, 2 Drawing Sheets

FINGERTIP GRIP RAIL FOR A WINDOW SHADE APPARATUS

BACKGROUND AND SUMMARY OF THE INVENTION

This invention pertains to an intermediate rail, commonly known as a day/night rail to incorporate within a window shade apparatus having two separate phases.

There are many instances wherein one may desire different levels of opaqueness covering a window. For example, one may desire to have a window uncovered, or one may desire a sunshade which is translucent but functions to reduce the glare coming in the window. One may also desire to cover the window with a relatively opaque shade.

Additionally, one may desire to have shades with distinct appearances for other reasons as well. For example, one may desire to have alternate decorative appearances wherein one shade presents a one pattern and another presents a different pattern. One may desire to change the decor of a room by merely adjusting a shade, thereby eliminating the need for additional shades.

In response to these needs, a multi-level adjustable window shade has been developed. An example of such a window shade is shown in FIG. 1, labeled as prior art.

The prior art, as shown in FIG. 1, depicts an intermediate rail 60 that is adjustable; however, a user frequently encounters difficulty adjusting the intermediate rail. The intermediate rail is positioned between a first pleated shade 52 and a second pleated shade 54. The first shade 52 has aligned apertures 56 allowing a cord 58 to pass through. The first shade 52 is anchored at one end by an first rail 62 that is mounted to an upper surface of a window frame not shown. The second shade 54 is attached at one end to the intermediate rail 60 and an end rail 64.

Still referring to FIG. 1, the cords 58 emanate from the first rail 62 and pass through each of the first shade 52, the intermediate rail 60, the second shade 54, and the end rail 64. After passing through the end rail 64, the cords 58 are customarily anchored to the window frame 70, but they need not be so anchored.

The prior art configuration, as shown in FIG. 1, however, presented difficulty in adjustment of the intermediate rail. One attempt at easing the difficulty has been to place tabs protruding from the intermediate rail (this embodiment is not shown) in order to ease the adjustability of the intermediate rail.

The present invention is an intermediate rail to be adjustably inserted between two distinct shades in a window shade apparatus with at least two distinct pleated shades. The intermediate rail has a length substantially equal to the length of a window shade.

The intermediate rail has a substantially planar, rectangular back wall facing a window and a first front wall generally parallel to the back wall and extending over a portion of the back wall. A second front wall relatively coplanar with, and spaced apart from, the first front wall, thereby defines a gap between an edge of first front wall and an edge of the second front wall.

An upper wall joins the first front wall to the back wall, and an inner wall extends inwardly from the gap, wherein a finger recess is formed in a region bounded by edges of the gap and the inner wall.

In one embodiment of the invention, one end of the inner wall may adjoin the upper wall between the first front wall and the back wall and a second end which abuts the second front wall. Alternatively, the innerwall may have a generally quarter-circle configuration at planes perpendicular to a longitudinal axis of the rail. Additionally, the inner wall may be any curve having concavity facing the upper wall.

In another embodiment of the invention, the inner wall may have a first section extending generally orthogonally from the upper wall and a second section joining the first section to the second front wall. In this embodiment, the second section may be formed as curve with concavity facing the upper wall, a semi-circle, or a generally planar wall.

Either embodiment may have a lip extending along at least one of the edges that define the gap in the fingertip recess or trough. Preferably, the rail is formed as a monolithic, one piece metal or plastic structure An end slat of a window shade is received within a channel formed by the first and second grooves along the upper wall. A single flange extends inwardly from an edge of the front wall and generally parallel to the upper wall to form a third groove between the inner wall and the single flange. A pair of parallel, inward facing flanges at an edge of the back wall form a fourth groove. A second channel is formed by a region bounded by the third and fourth grooves; an end slat of a window shade is received within the second channel.

This unique configuration of the intermediate rail eases the burden of raising and lowing the intermediate shade. Other objects, advantages and novel features of the present invention will become apparent from the following detailed description of the invention when considered in conjunction with the accompanying drawings.

DETAILED DESCRIPTION OF THE PREFERRED EMBODIMENTS

Figure 1:
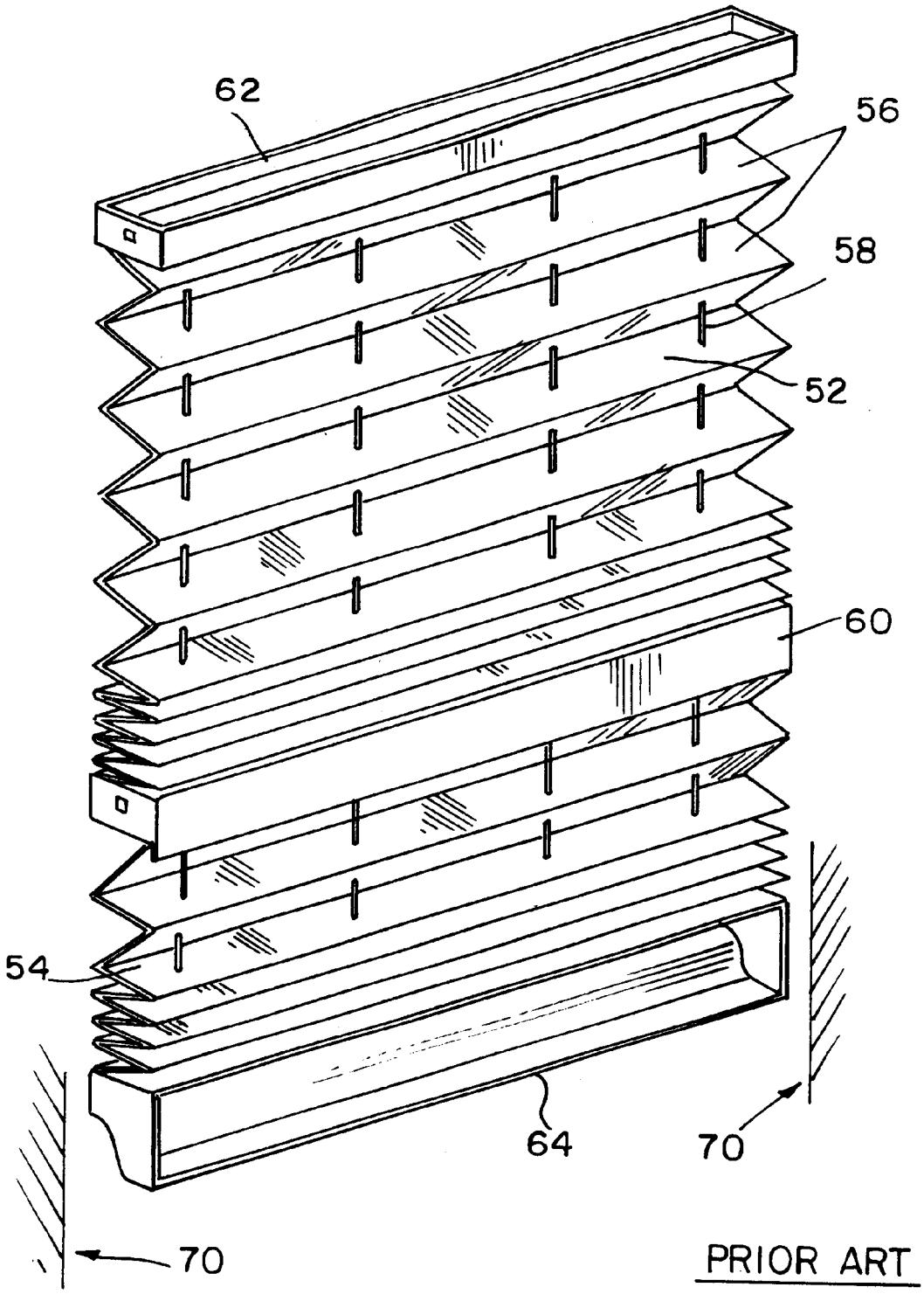
PRIOR ART FIG. 1
FIG. 1 is a perspective view of the prior art.

This invention pertains specifically to an intermediate rail, also known as a day/night rail, for use in a two phase window shade apparatus. The intermediate rail 31 is designed to extend substantially across the length of an end slat of a pleated window shade.

The rail comprises a back wall 2 which faces a window, and a front wall 3 having two distinct parts: a first front wall 4 and a second front wall 6. The first front wall 4 is spaced apart from the back wall and extends over at least a portion of the back wall 2. The second front wall 6 generally coplanar with the first front wall 4 and spaced apart from the first front wall 4. A gap 8 is formed between the first front wall 4 and the second front wall 6. Additionally, an upper wall 10 connects the first front wall 4 to the back wall 2.

An inner wall 12 extends inwardly from the gap 8. In one embodiment, as set forth in FIG. 2, the inner wall 12 is defined by a first section 26 extending from the upper wall 10. The inner wall 12 further comprises a second section 28 which joins the first section 26 to the second front wall 6. In this embodiment, the inner wall 12 therefore connects the upper wall 10 to the second front wall 6. Additionally, the second section 28 may be substantially planar, a curved wall, a curve with concavity facing the upper wall 10, or any other suitable formation.

Figure 3:
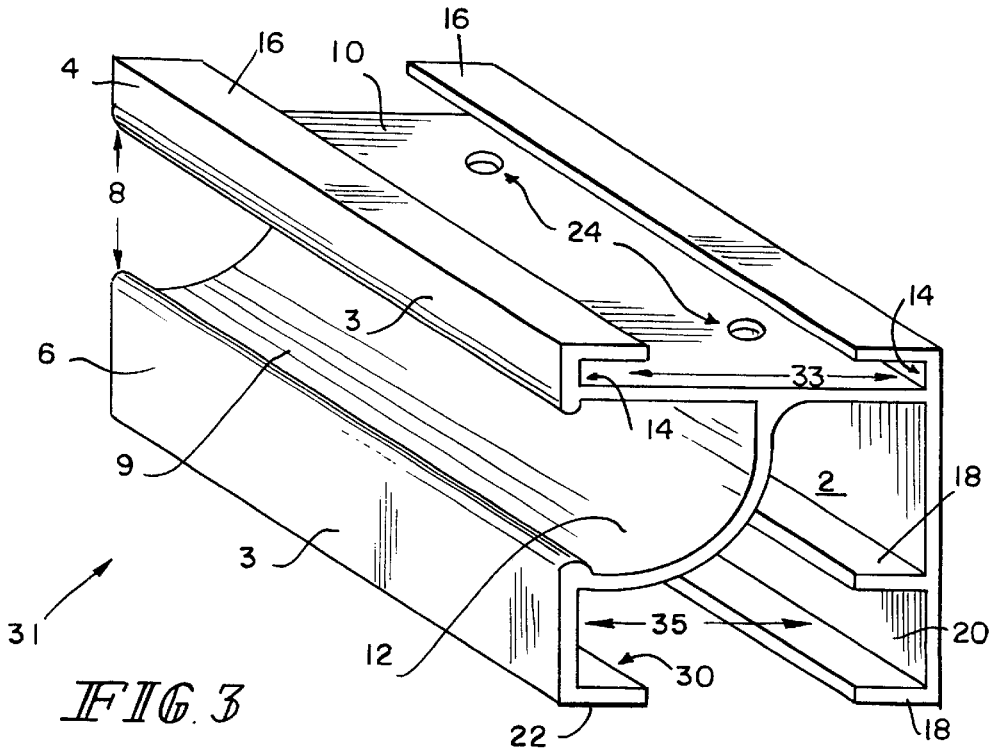
FIG. 3 is a perspective drawing of a second embodiment the invention.

In another embodiment, as set forth in FIG. 3, the inner wall comprises, at planes perpendicular to a longitudinal axis of the rail, a general quarter-circle that connects the upper wall 10 to the second front wall 6. Additionally, the shape of the inner wall may be defined by a curve having a concavity facing the upper wall 10, or any other suitable configuration.

Figure 2:
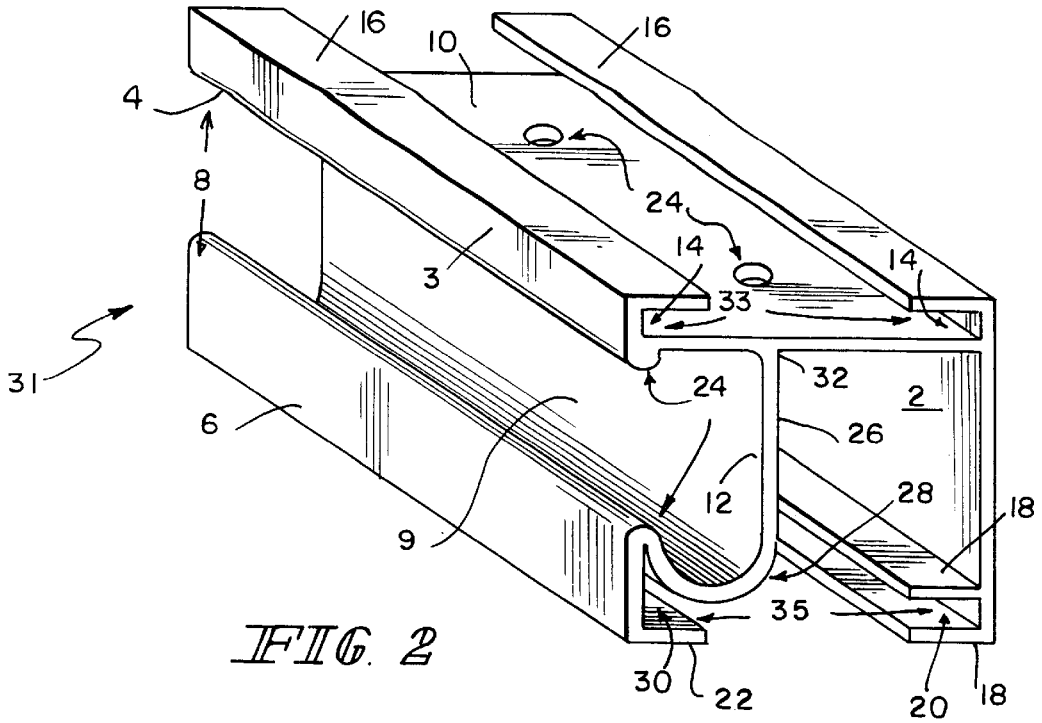
FIG. 2 is a perspective drawing of one embodiment of the invention.

Referring to FIGS. 2 and 3, a fingertip recess 9 is formed wherein the gap and the inner surface define an inward-extending trough or recess 9 that runs longitudinally along the rail. This trough or recess 9 should be sufficiently large in order to accommodate the fingertips of a user.

It is also to be understood that the inner wall 12 may define a boundary that connects the first front wall 4 to the second front wall 6. This embodiment is not set forth in the figures, however.

From front wall 4 is a flange 16 which extends over at least a portion of the upper wall 10. Additionally, a second flange 16 extends from an edge of the back wall 2 over at least a portion of the upper wall 10. The flanges 16 form upper grooves 14 along the edges of the upper wall 10. These grooves 14 form a channel 33 for receipt of an end slat of a first section of the window shade apparatus.

The intermediate rail further comprises a pair of parallel flanges 18 extending from the lower edge of the back wall 2. Note that the parallel flanges 18 form a groove 20 therebetween. Additionally, a single flange 22 extends inwardly from the second front wall 6. The inner wall 12, or at least the second section 28 of the inner wall 12 should be formed in such a manner as to form a third groove 30 between the flange 22 and the lower portion of the inner wall 12. Accordingly, a second channel 35 for receipt of an end slat of a second pleated window shade is formed by the grooves 20 and 30. In order to improve one's grip in the recess 9, a lip 24 may be formed at either or both of the edges of the gap 8.

The rails are preferably formed as a one-piece monolithic structure made of a light weight metal such as steel or aluminum, but could be formed from plastic.

As shown in FIG. 2, the inner wall 12 may comprise two distinct sections: a first section 26 extending generally parallel to the back wall 2 connected to a second section 28 that connects the first section of the inner wall 12 to the second front wall 6. The first section 26 extends from the upper wall 10 at a position 32 between the first front wall 4 and the back wall 2. Preferably, the position 32 is located on the upper wall 10 between the first front wall 4 and apertures 24, so as to allow space for cords (not shown) to pass between the inner wall 12 and the back wall 2.

In FIG. 2, the second section 28 of the inner wall 12 is depicted as a semi-circle; however, the second section 28 may also take the form of a generally planar wall or any other appropriate configuration which would connect the first section 26 to the second front wall 6.

FIG. 3 depicts an embodiment of the rail 31 wherein the inner wall 12 has, at cross sections perpendicular to the longitudinal axis of the rail 31, a generally semicircular form. It is also of note that the top wall 10 should contain apertures 24 to accommodate the cord (not shown in FIG. 3) on which the intermediate rail 31 is slidably mounted. The inner wall 12 and the apertures should be configured such that the apertures 24 on the upper wall allow a cord (not shown) to run between the inner wall 12 and the back wall 2. As in the embodiment shown in FIG. 2, the embodiment of FIG. 3 has analogous flanges 16,18,22 which form analagous grooves 14,20,30.

FIGS. 2 and 3 both depict the inner wall joining the front wall 6 at an upper edge of the front wall 6; however, the second section 28 may join the front wall at a location displaced from an upper edge.

The recess 9 of FIG. 3 appears deeper than the recess 9 of FIG. 2. Additionally, the apertures 24 of FIG. 3 appear nearer the back wall 2 than in FIG. 2. These differences, although apparently depicted in the drawings, need not be present. Rather, the placement of the apertures 24 and the inner wall 12 can be of any suitable placement or configuration. It is important to note, however, that the apertures 24 are preferably aft of the location 32 in order to allow a cord (not shown) to pass between the back wall 2 and the inner wall 12.

It is also of note that the grooves 20 and 30 of FIG. 3 appear to be wider than the grooves 20 and 30 of FIG. 2. However, the configurations as depicted are not critical. Specifically, an embodiment having a uniformly curved inner wall 12 (such as FIG. 3) need not accompany a rail with a larger lower channel. Rather, each embodiment is shown by way of example to illustrate that the size and shapes of the grooves may vary, thereby changing the dimensions of the channels.

Additionally, in order to prevent the ends of the intermediate rail from scratching portions of the window frame, a cap (not shown) of any suitable material may be placed on the ends of the rail.

Although the present invention has been described and illustrated in detail, it is to be clearly understood that the same is by way of illustration and example only, and is not to be taken by way of limitation. The spirit and scope of the present invention are to be limited only by the terms of the appended claims.

We claim:

1. An intermediate rail to be adjustably inserted between two distinct shades in a window shade apparatus, the apparatus having at least two distinct pleated shades, the intermediate rail having a length substantially equal to the shades, and further comprising:

a substantially planar, rectangular back wall facing a window;

a first front wall generally parallel to the back wall and extending over a portion of the back wall;

a second front wall relatively coplanar with, and spaced apart from, the first front wall, thereby defining a gap between an edge of first front wall and an edge of the second front wall;

an upper wall joining the first front wall to the back wall;

an inner wall extending inwardly from the gap, wherein a finger recess is formed in a region bounded by edges of the gap and the inner wall.

2. The intermediate rail as in claim 1, wherein one end of the inner wall adjoins the upper wall at a location disposed between the first front wall and the back wall and a second end which abuts the second front wall.

3. The intermediate rail as in claim 2, wherein the inner wall has a generally quarter-circle configuration at planes perpendicular to a longitudinal axis of the rail.

4. The intermediate rail as in claim 2, wherein the inner wall has a first section extending generally orthogonally from the upper wall; and, a second section joining the first section to the second front wall.

5. The intermediate rail as in claim 4, wherein the second section may be formed as any one of the following configurations:

curve with concavity facing the upper wall; or semi-circle; or a planar wall.

6. The intermediate rail as in claim 1, further comprising a lip extending along at least one of the edges that define the gap.

7. The intermediate rail as in claim 1, wherein the rail is formed as a monolithic, one piece structure.

8. The intermediate rail as in claim 7, wherein the rail is made of metal.

9. The intermediate rail as in claim 7, wherein the rail is made of plastic.

10. The intermediate rail as in claim 1, further comprising opposite facing flanges extending inwardly from opposite ends of the upper wall to form first and second grooves along the upper wall;

wherein an end slat of a window shade is received within a channel formed by the first and second grooves along the upper wall;

a single flange extending inwardly from an edge the front wall and generally parallel to the upper wall;

wherein a third groove is formed between the inner wall and the single flange;

a pair of parallel, inward facing flanges at an edge of the back wall and forming a fourth groove;

wherein a second channel is formed by a region bounded by the third and fourth grooves; and wherein an end slat of a window shade is received within the second channel.

11. An intermediate rail incorporated into an adjustable window shade apparatus that is mounted in a window frame near a window, the apparatus having a first rail anchored to a wall of the window frame, a first pleated shade mounted to the first rail, an end rail mounted to a second pleated shade wherein at least one cord extends from the end rail through aligned apertures in each of the first and second shades, the cord then passing through apertures in the end rail, the intermediate rail situated between and mounted to the first and second shade, and further comprising:

a back wall facing the window;

an upper wall displaced from a first edge of the back wall;

apertures on the upper wall which allow the cord to pass therethrough;

a front wall spaced apart from the back wall and extending from a second edge of the upper wall, the front wall having a gap extending in a longitudinal direction across the rail, the gap defining an opening of an inwardly-extending trough; and an inner wall defining a boundary of the trough.

12. The intermediate rail of claim 11 further comprising:

a first upper flange member extending from the first edge of the back wall and generally parallel to the upper wall and over at least a portion of the upper wall, thereby forming a first upper groove between the upper wall and the first upper flange;

a second upper flange member extending from an edge of the front wall and generally parallel to the upper wall, the second upper flange member extending over at least a portion of the upper wall;

wherein a second upper groove is formed between the upper wall and the second upper flange;

so that the first and second upper grooves form a first channel receiving an end slat from the first shade.

13. The intermediate rail of claim 11, further comprising:

a pair of parallel lower flange members extending from an edge of the back wall and generally parallel to the upper wall, forming a first lower groove between the parallel lower flange members;

a third lower flange member extending inwardly from the front wall so as to form a second lower groove between the inner wall and the third lower flange; and wherein the first and second lower grooves form a second channel receiving an end slat from the second shade.

14. The intermediate rail as in claim 11, wherein one end of the inner wall abuts the upper wall at a location disposed between the front wall and the back wall and a second end which abuts the front wall, so as to form a recess having an opening at the gap and bound by the front wall, the inner wall, and the upper wall.

15. The intermediate rail as in claim 11, further comprising at least one lip formed on at least one edge of the gap.

16. The intermediate rail as in claim 11, wherein the rail is formed as a monolithic, one piece structure.

17. The intermediate rail as in claim 16, wherein the rail is metal.

18. The intermediate rail as in claim 16, wherein the rail is plastic.

* * * * *